US009129557B2

(12) United States Patent
Yeo

(10) Patent No.: US 9,129,557 B2
(45) Date of Patent: Sep. 8, 2015

(54) ORGANIC LIGHT EMITTING DISPLAY DEVICE AND DRIVING METHOD THEREOF

(71) Applicant: Samsung Display Co., Ltd., Yongin, Gyeonggi-Do (KR)

(72) Inventor: Sang-Jae Yeo, Yongin (KR)

(73) Assignee: Samsung Display Co., Ltd. (KR)

( * ) Notice: Subject to any disclaimer, the term of this patent is extended or adjusted under 35 U.S.C. 154(b) by 3 days.

(21) Appl. No.: 14/043,159

(22) Filed: Oct. 1, 2013

(65) Prior Publication Data

US 2014/0354701 A1 Dec. 4, 2014

(30) Foreign Application Priority Data

May 30, 2013 (KR) ..... 10-2013-0062054

(51) Int. Cl.
*G09G 3/32* (2006.01)

(52) U.S. Cl.
CPC ..... *G09G 3/3208* (2013.01)

(58) Field of Classification Search
CPC . G09G 3/3233; G09G 3/3258; G09G 3/3208; G09G 2300/0819; G09G 2300/0861; G09G 2300/0842; G09G 3/3225
USPC ..... 345/690, 77, 76, 80; 315/169.1, 169.3
See application file for complete search history.

(56) References Cited

U.S. PATENT DOCUMENTS

| | | | | |
|---|---|---|---|---|
| 2004/0046718 | A1* | 3/2004 | Osame et al. | 345/80 |
| 2006/0007249 | A1* | 1/2006 | Reddy et al. | 345/690 |
| 2006/0221007 | A1* | 10/2006 | Kim | 345/76 |
| 2008/0094334 | A1* | 4/2008 | Baek et al. | 345/89 |
| 2012/0050234 | A1* | 3/2012 | Jang et al. | 345/204 |

FOREIGN PATENT DOCUMENTS

| | | | |
|---|---|---|---|
| KR | 1020050058473 | A | 6/2005 |
| KR | 1020100099946 | A | 9/2010 |
| KR | 1020100118773 | A | 11/2010 |
| KR | 1020110013689 | A | 2/2011 |

* cited by examiner

*Primary Examiner* — Olga Merkoulova
(74) *Attorney, Agent, or Firm* — Innovation Counsel LLP

(57) ABSTRACT

An organic light emitting diodes (OLED's) display has differently composed OLED's with respective different voltage-to-current characteristic curves. Variable power voltages are applied to the subpixels of these differently composed OLED's based on their respective voltage-to-current characteristic curves. In one embodiment, a display unit includes first subpixels emitting respective lights according to first image data representing a first color, second subpixels emitting respective lights according to second image data representing a second color, and third subpixels emitting respective lights according to third image data representing a third color, wherein the first, and second subpixels are powered by a first variable voltage power supply and the third subpixels are powered by a second and independently variable voltage power supply.

6 Claims, 5 Drawing Sheets

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2013-0062054 filed in the Korean Intellectual Property Office on May 30, 2013, the entire contents of which application are incorporated herein by reference.

BACKGROUND

1. Field

The present disclosure of invention relates to an organic light emitting diodes (OLED's) display having differently colored OLED's and to a driving method thereof.

2. Description of Related Technology

Display devices are used for displaying images for portable and/or handheld apparatuses such as personal computers, mobile phones, and PDAs, or as monitors for various types of information devices. The display devices may be of different kinds including a liquid crystal display device (LCD) using an LCD panel, an organic light emitting diode (OLED) display using organic light emitting elements, a plasma display panel (PDP) using a plasma panel, and the like. Particularly, OLED display have come into the spotlight, because they have high light-emitting efficiency, good and luminance, a wide viewing angle, and a fast response speed.

The typical organic light emitting diode (OLED) is formed as a deposition thin film structure including a photons emitting layer (EML) and a holes transport layer (HTL) disposed between a cathode electrode and an anode electrode. Also, for increasing luminous efficiency through improvement of the injection and movement characteristics of the electrons and of the holes, the organic light emitting element may further include an electrons injecting layer (EIL), a holes injection layer (HIL), and a holes blocking layer (HBL).

In general, the organic light emitting diode (OLED) display is formed as a plurality of multi-color unit pixels by including a red subpixel, a green subpixel, and a blue subpixel in each unit pixel, thereby displaying images of various colors. However, the electro-optical characteristics of the organic light emitting materials that respectively output different colors such as the red, the green, and the blue colors are different from one another such that different operating voltages are developed in the driving of the red, green, and blue subpixels.

In general, the driving of the OLED's is current based and the power supply voltages for driving the red, green, and blue subpixels are set to be the same for each of the subpixels with reference to a full white grayscale. In this case, the differences of the operating voltages of the red, green, and blue subpixels are not considered such that unnecessary power wastage occurs because an excessively large power supply voltage is used for those of the different OLED's that have the lowest operating voltages.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

The present disclosure of invention provides an organic light emitting diodes (OLED's) containing display having reduced power consumption.

More specifically, an organic light emitting diodes (OLED's) display in accordance with the present disclosure has differently composed OLED's with respective different voltage-to-current characteristic curves. Variable power voltages are applied to the subpixels of these differently composed OLED's based on their respective voltage-to-current characteristic curves. In one embodiment, a display unit includes first subpixels emitting respective lights according to first image data representing a first color, second subpixels emitting respective lights according to second image data representing a second color, and third subpixels emitting respective lights according to third image data representing a third color, wherein the first, and second subpixels are powered by a first variable voltage power supply and the third subpixels are powered by a second and independently variable voltage power supply. Yet more specifically, and in one embodiment, the red subpixels are driven by an independently variable power voltage while the green and blue subpixels are driven by a separate and independently variable power voltage.

An organic light emitting diode (OLED) display of the present disclosure includes: a display unit including a plurality of data lines, a plurality of scan lines, a plurality of first subpixels emitting light according to first image data representing a first color, a plurality of second subpixels emitting light according to second image data representing a second color, and a plurality of third subpixels emitting light according to a third image data representing a third color, wherein the plurality of first, second, and third subpixels are connected to the corresponding data lines and the corresponding scan lines; a scan driver supplying a plurality of scan signals to the plurality of scan lines; a data driver generating a plurality of data signals corresponding to the first to third image data and supplying a plurality of data signals to the plurality of data lines; and a power supply unit applying a variable first driving power voltage to the plurality of first and second subpixels and applying an independently variable second driving power voltage (for example one of a different magnitude) to the plurality of third subpixels.

The first color may be one of green and blue, the second color may be the other of green and blue, and the third color may be red. A power source controller automatically determines or extracts each maximum grayscale value of the first to third image data for one frame unit controlling the first and second driving voltages according to the extracted maximum grayscale value may be further included.

The power source controller may vary the magnitude of the first driving voltage by corresponding to the largest grayscale value among the maximum grayscale values of the first and second image data, and may vary the magnitude of the second driving voltage by corresponding to the maximum grayscale value of the third image data.

The plurality of first to third subpixels may respectively include an OLED driving transistor and an organic light emitting diode (OLED) connected serially between a first or second driving voltage supplying terminal and a third driving voltage supplying terminal; and a switching transistor transmitting the corresponding data signal to a gate of the driving transistor according to the corresponding scan signal.

A method of driving an organic light emitting diodes (OLED's) containing display including a plurality of data lines, a plurality of scan lines, a plurality of first subpixels emitting light according to first image data representing a first color, a plurality of second subpixels emitting light according to second image data representing a second color, and a plurality of third subpixels emitting light according to third image data representing a third color, wherein the plurality of first, second, and third subpixels are connected to the corresponding data lines and the corresponding scan lines, includes: respectively applying a first driving voltage to the plurality of first and second subpixels; and respectively applying an independently variable second driving voltage (e.g., one of a different magnitude from the first driving voltage) to the plurality of third subpixels, wherein the first color is one of green and blue, the second color is the other of green and blue, and the third color is red.

The applying of the first driving voltage may include extracting each maximum grayscale value of the first and second image data by one frame unit, and varying the first driving voltage according to the largest grayscale value among the extracted maximum grayscale values.

The applying of the second driving voltage may include extracting a maximum grayscale value of the third image data by one frame unit, and varying the second driving voltage according to the extracted maximum grayscale value.

An exemplary embodiment of the present invention relates to the organic light emitting diode (OLED) display and a driving method thereof, wherein power consumption may be reduced by dividing and driving the operation voltage between the red subpixel, and the green and blue subpixels.

DETAILED DESCRIPTION

Figure 1:
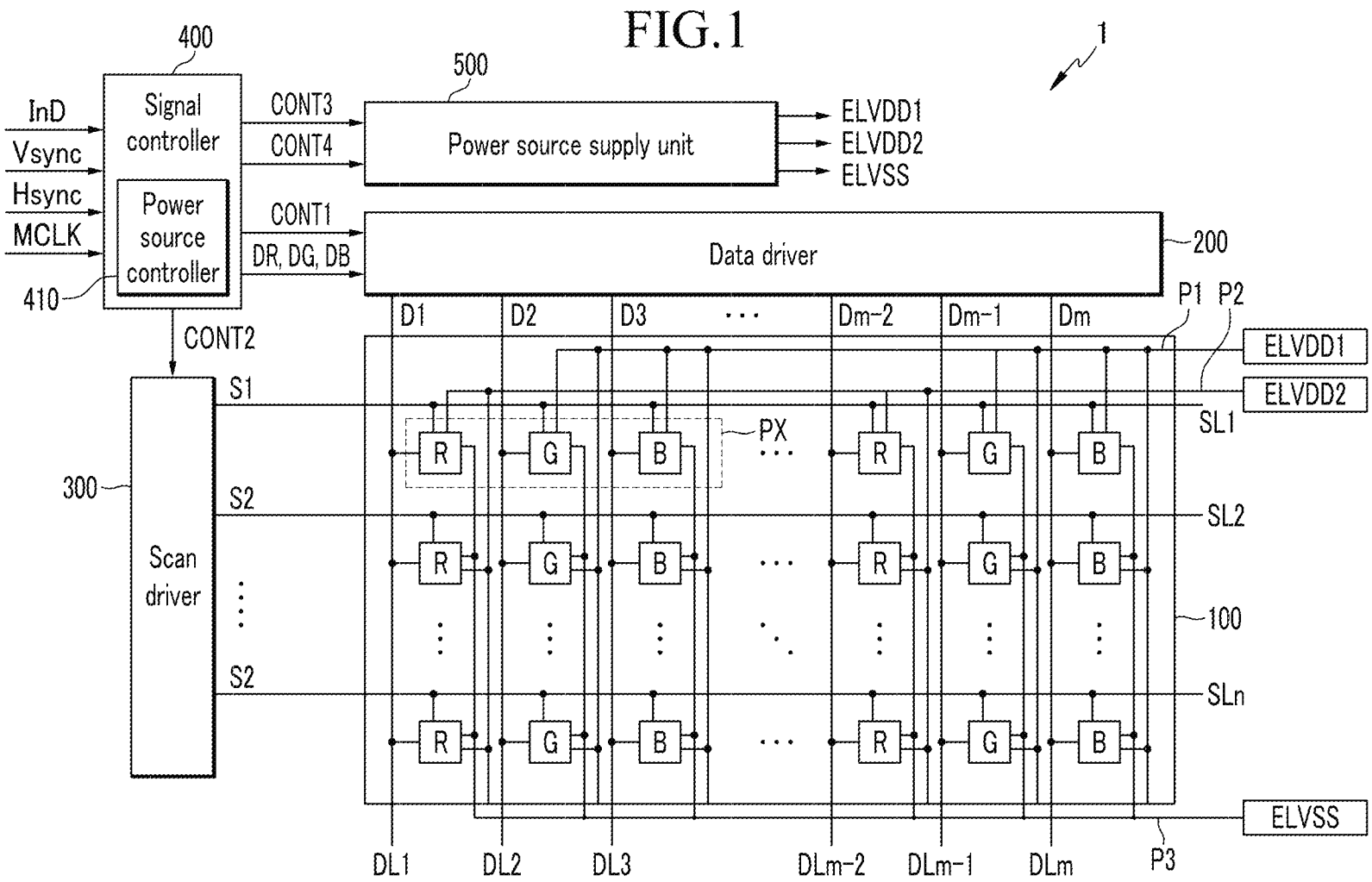
FIG. 1 is a block diagram of an organic light emitting diodes (OLED) display according to an exemplary embodiment of the present disclosure.

In the following detailed description, only certain exemplary embodiments of the present disclosure of invention are shown and described, simply by way of illustration. As those skilled in the art would realize in view of the disclosure, the described embodiments may be modified in various different ways, all without departing from the spirit or scope of the present teachings. Accordingly, the drawings and description are to be regarded as illustrative in nature and not restrictive. Like reference numerals designate like elements throughout the specification.

Throughout this application and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

The present teachings will be provided more fully hereinafter with reference to the accompanying drawings, in which exemplary embodiments are shown.

Figure 2:
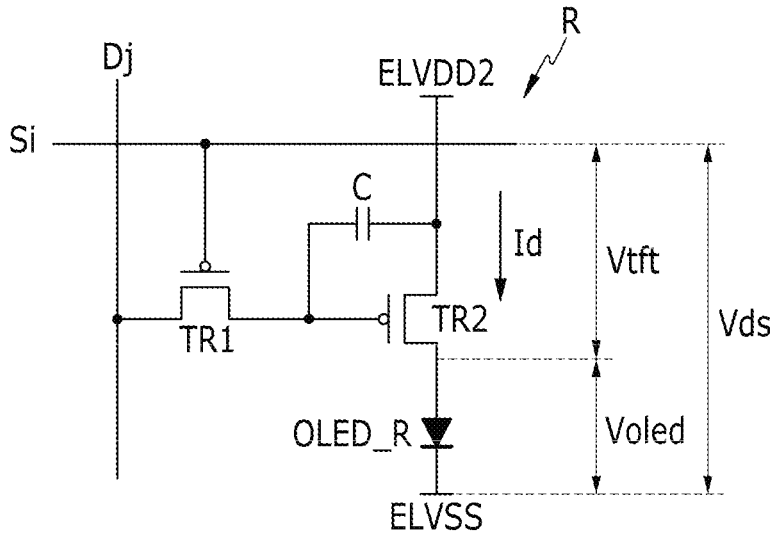
FIG. 2 is an equivalent circuit of a subpixel sPX according to an exemplary embodiment.
Figure 3:
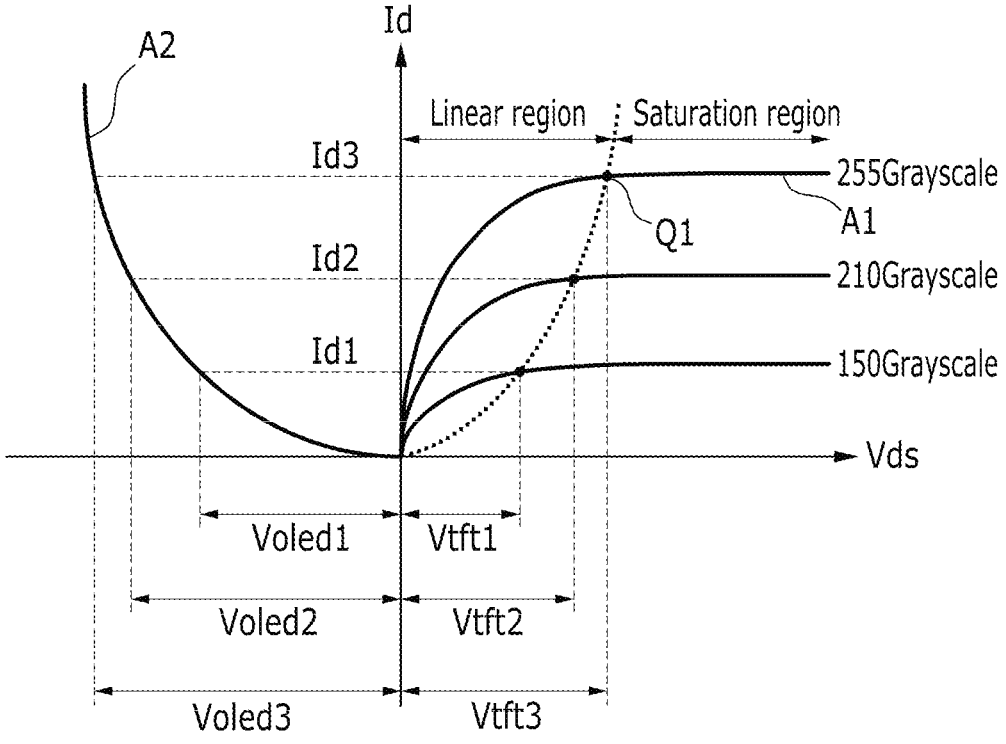
FIG. 3 is a view to explain a characteristic curve of a driving transistor TR2 and a correspondingly driven organic light emitting diode (OLED).

FIG. 1 is a block diagram of an organic light emitting diodes (OLED's) display according to an exemplary embodiment. FIG. 2 is an equivalent circuit of a red subpixel sPX according to an RGB pixel of the exemplary embodiment. FIG. 3 is a view to explain a characteristic curve of a driving transistor TR2 and an organic light emitting diode (OLED).

Referring to FIG. 1, an organic light emitting diodes (OLED's) containing display 1 according to an exemplary embodiment includes a display unit 100, a data driver 200, a scan driver 300, a signal controller 400, and a power supply unit 500.

The display unit 100 includes a plurality of pixels PX, and further includes a plurality of scan lines SL1-SLn, a plurality of data lines DL1-DLm, and first to third driving voltage supplying lines P1-P3. The plurality of pixels PX each respectively includes red, green, and blue subpixels R, G, and B. Here, each of the respective green and blue subpixels G and B of the plural pixels PX are connected to the first and third driving voltage supplying lines P1 and P3 while the red subpixel R is differently connected to the second and third driving voltage supplying lines P2 and P3. Here, the first driving voltage supplying line P1 is connected to receive a first driving voltage ELVDD1, and the second driving voltage supplying line P2 is connected to receive a different, second driving voltage ELVDD2. The third driving voltage supplying line P3 is connected to receive a common third driving voltage ELVSS.

For example, among the plurality of subpixels sPX, the red subpixel R connected to the i-th scan line SL[i] and the j-th data line DL[j] includes a switching transistor TR1, a driving transistor TR2, a capacitor C, and a red organic light emitting diode (OLED_R) as shown in FIG. 2. The switching transistor TR1 includes a gate electrode connected to the scan line SL[i], a source electrode connected to the data line DL[j], and a drain electrode connected to the gate electrode of the driving transistor TR2.

The driving transistor TR2 includes a source electrode connected to the second driving voltage supplying line P2 and receiving the second driving voltage ELVDD2. It further includes a drain electrode connected to an anode of the red organic light emitting diode (OLED_R), and a gate electrode coupled to receive a data signal Dj from data line $DL_j$ while the switching transistor TR1 is turned on.

The capacitor C is connected at its opposed terminals to the gate electrode and the source electrode of the driving transistor TR2. A cathode of the red organic light emitting diode (OLED_R) is connected to the third driving voltage supplying line P3 to receive the third driving voltage ELVSS.

In this illustrated subpixel sPX, if the switching transistor TR1 is turned on by the scan signal S[i], the data signal Dj is transmitted to the gate electrode of the driving transistor TR2. A voltage difference between the gate electrode and the source electrode of the driving transistor TR2 is maintained by the capacitor C, and a driving current Id flows through the driving transistor TR2. The red organic light emitting diode (OLED_R) emits light according to the magnitude of the driving current Id.

The present disclosure of invention is not limited to the above exemplary embodiment, and the subpixel sPX of FIG. 2 is merely an example of a subpixel within a multicolored display device where other types and configurations of subpixels can be used (e.g., RGBW OLED's).

The data driver 200 receives and processes red, green, and blue image data signals DR, DG, and DB to be suitable for predetermined characteristics of the corresponding display unit 100 and in accordance with a provided data driving control signal CONT1 to thereby generate a plurality of analog data line signals D[1]-D[m]. The data driver 200 transmits the generated plurality of corresponding data line signals D[1]-D[m] to the corresponding plurality of data lines DL[1]-DL[m] of the display unit 100, respectively.

The scan driver 300 generates a plurality of scan signals S[1]-S[n] according to a scan driving control signal CONT2, and transmits a plurality of scan signals S[1]-S[n] to the corresponding scan lines SL[1]-SL[n], respectively.

The signal controller 400 receives input data InD and a synchronization signal from an outside source and responsively generates the first driving control signal CONT1, the second driving control signal CONT2, and the red, green, and blue image data signals DR, DG, and DB. Here, the synchronization signal includes a horizontal synchronization signal Hsync, a vertical synchronization signal Vsync, and a main clock signal MCLK. The signal controller 400 divides the input data InD by frame units according to the vertical synchronization signal Vsync. Also, the signal controller 400 divides the input data InD by scan line units according to the horizontal synchronization signal Hsync to thereby generate the red, green, and blue image data signals DR, DG, and DB in synchronism with the Vsync and Hsync signals.

The signal controller 400 includes a power source controller 410 configured for generating first and second power source control signals CONT3 and CONT4 by using a distribution for each grayscale of the red, green, and blue image data DR, DG, and DB. In detail, the power source controller 410 generates a histogram for the distribution of each grayscale of the red, green, and blue image data DR, DG, and DB on a per image frame basis and extracts each maximum grayscale value of the red, green, and blue image data DR, DG, and DB. The power source controller 410 generates the first power source control signal CONT3 according to a largest grayscale value among the respective maximum grayscale values of the extracted green and blue image data signals DG and DB. The power source controller 410 generates the second power source control signal CONT4 according to the maximum grayscale value of the extracted red image data signal DR.

Here, the power source controller 410 may use a characteristic curve of the driving transistor TR2 and a characteristic curve of the organic light emitting diode (OLED) shown in FIG. 2. For example, in FIG. 3, a first characteristic curve A1 (which saturates at a current level ID3 corresponding to a grayscale value of 255) is provided as indicating the relationship between the drain-source voltage Vtft and the drain current Id of the driving transistor TR2 when a corresponding first gate voltage is applied. At the same time, a second characteristic curve A2 (rising to the left and not to be confuse with the linear versus saturated dividing curve for the TFT shown on the opposed side of the Id axis) is provided as indicating the relationship between the drain current Id and a voltage Voled developed across the organic light emitting diode (OLED). Here, information about the respective characteristic curves A1 and A2 of the TFT (TR2) and the OLED respectively may be stored for example as sample points in data lookup table (LUT) where the data of these characteristic curves A1 and A2 is stored in or otherwise made available to the power source controller 410. Also, the power source controller 410 may vary the first and second driving voltages ELVDD1 and ELVDD2 based on the maximum grayscale to be achieved in a frame and with reference to the dashed boundary position curve that divides as between a linear region of operation and a saturation region of operation for the TFT as taken along respective characteristic curves, for example, A1(255), A1(210), A1(150) of the OLED driving transistor TR2. Further, different and respective OLED characteristic curves A2(R), A2(G), A2(B) may be previously stored in respective LUT's (not shown) and corresponding to the red subpixel R, the green subpixel (G) and the blue subpixel B. In one embodiment, the green and blue OLED's (G and B) are assumed to have substantially same A2 characteristic curves (A2(G)=A2(B)) and thus a common one LUT is used for both. On the other hand, the red OLED is taken to have a substantially different A2 characteristic curve and its sample points are stored in a separate LUT. (In one embodiment, extrapolation is used for input and output values in between the stored sample points.)

Also, the power supply unit 500 receives an externally supplied input voltage Vin for generating therefrom the first to third driving voltages ELVDD1, ELVDD2, and ELVSS. The power supply unit 500 variably controls the first and second driving voltages ELVDD1 and ELVDD2 according to the first and second power source control signals CONT3 and CONT4.

Figure 4:
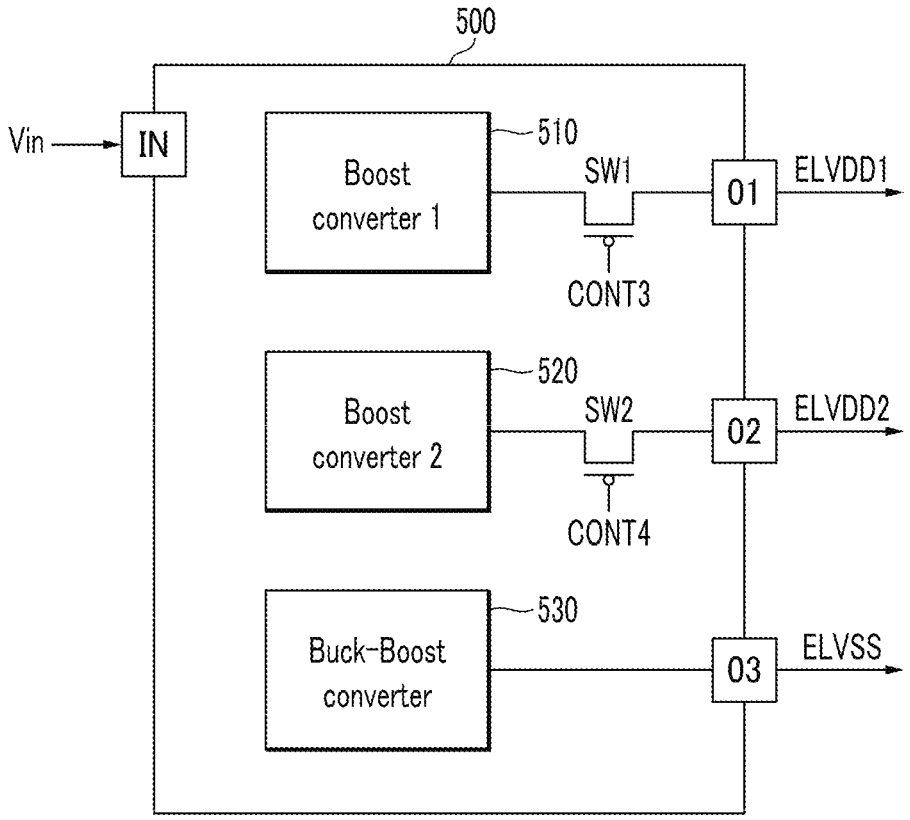
FIG. 4 is a detailed block diagram of a power supply such as the unit 500 shown in FIG. 1.

FIG. 4 is a detailed block diagram of the power supply unit 500 shown in FIG. 1.

Referring to FIG. 4, the power supply unit 500 includes an input terminal IN receiving the externally input voltage Vin, and first to third output terminals O1-O3 outputting the first to third DC driving voltages ELVDD1, ELVDD2, and ELVSS. Here, the first to third output terminals O1-O3 are connected to the first to third driving voltage supplying lines P1-P3, respectively.

The power supply unit 500 includes a first boost converter 510, a second boost converter 520, and a buck-boost converter 530. The first boost converter 510 receives the input voltage Vin, converts the input voltage Vin into the first driving voltage ELVDD1 according to the first power source control signal CONT3, and outputs the first driving voltage ELVDD1. For this, the first boost converter 510 includes a first switch SW1. The second boost converter 520 receives the input voltage Vin, converts the input voltage Vin into the second driving voltage ELVDD2 according to the second power source control signal CONT4, and outputs the second driving voltage ELVDD2. For this, the second boost converter 520 includes a second switch SW2. It is to be understood that the positionings of the illustrated switches SW1, SW2 is merely schematic and that such switches may be elsewhere placed in, for example, respective switched inductive circuits (details not shown).

The buck-boost converter 530 receives the input voltage Vin and generates the third driving voltage ELVSS. The buck-boost converter 530 may include a third switch (not shown) controlling a magnitude of the third driving voltage ELVSS. In an exemplary embodiment of the present disclosure, a case outputting the third driving voltage ELVSS as a fixed value is described, but other embodiments are not limited thereto and ELVSS may also be a controlled variable.

Figure 5:
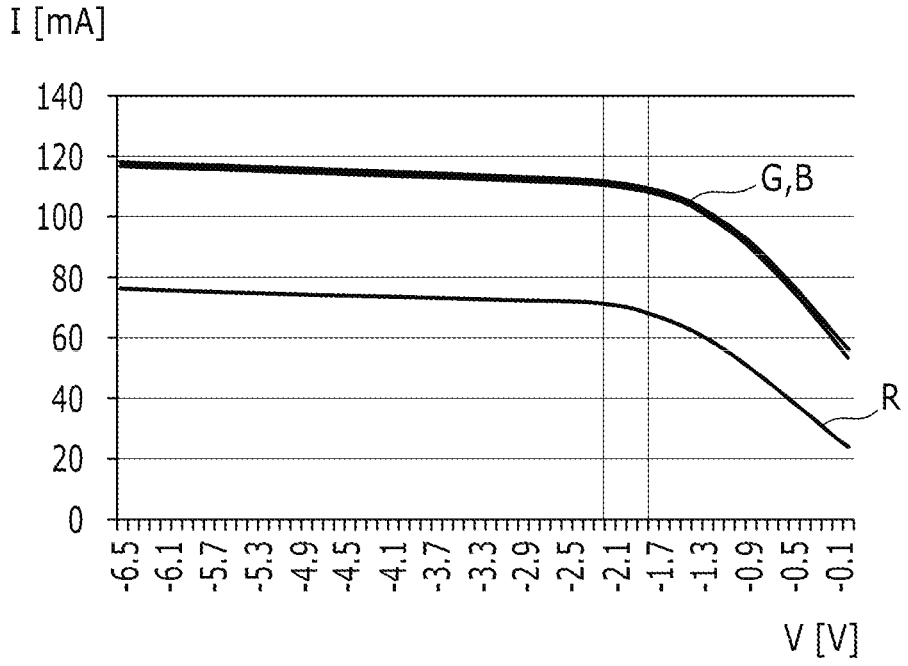
FIG. 5 is a view showing respective current-voltage transfer curves of red, green, and blue subpixels R, G, and B of one embodiment.

FIG. 5 is a view of each current-voltage curved line of red, green, and blue OLED's R, G, and B.

Referring to FIG. 5, the magnitudes of the operation voltages are different according to the characteristic of each organic light emitting material of the respective red, green, and blue OLED's, R, G, and B. Here, among the red, green, and blue OLED's R, G, and B, the operation voltages of the green and blue OLED's G and B are substantially similar in range, however the operation voltage of the red OLED R has a different range from that of the green and blue OLED's G and B. More specifically, the current draw of the red OLED R in its generally linear operability range is about 33% less than those of the green and blue OLED's G and B in their respective linear operability ranges.

Accordingly, the power source controller 410 according to the illustrated exemplary embodiment independently controls the first driving voltage ELVDD1 used for driving the green and blue subpixels G and B and the second driving voltage ELVDD2 used for driving the red subpixel R. Power consumption may be reduced with such a separate powering system because the driving transistor TR2 for the red OLED does not have to conduct as large a magnitude of current Id for the red OLED R as do the respective driving transistors TG2, TB2 (not shown) for the green and blue OLED's G and B in their respective linear operability ranges. Hence a lower maximum powering voltage may be used for the red subpixel R. Thus not as much power is wasted in the red driving transistor TR2 for driving the red OLED as it would be if an alternate method were used where a single power supply voltage (e.g., ELVDD1=ELVDD2) were simultaneously used for all three OLED's (r, G and B).

Also, the power source controller 410 varies the magnitudes of the first and second driving voltages ELVDD1 and ELVDD2 according to the largest grayscale value among the maximum grayscales of the green and blue image data DG and DB and the maximum grayscale of the red image data DR thereby reducing the power consumption of each on an as-needed-in the-frame basis. For example, when for a given image frame, the maximum grayscale value of the red image data DR is a grayscale value of 150 (having a red OLED drive current magnitude of Id1), the operational power voltage ELVDD2-ELVSS requires a sum magnitude of Voled1 and Vtft1 in the characteristic curve shown in FIG. 3. Accordingly, instead of setting the operational power voltage ELVDD2-ELVSS as the full white grayscale value for attaining current magnitude Id3, that is, the one for the grayscale value of 255 out of 255 (8 bits), the power controller sets it for the sum magnitude of Voled1 and Vtft1 and thus the power consumption may be largely reduced.

Further, by simultaneously controlling the respective operational power voltage ELVDD2-ELVSS of the green and blue subpixels G and B with one power control circuit, only two driving voltage supplying lines P1 and P2 may be disposed. Accordingly, a reduced layout area may be secured.

While this disclosure of invention has been described in connection with what is presently considered to be practical exemplary embodiments, it is to be understood that the present teachings are not limited to the disclosed embodiments, but, on the contrary, the teachings are intended to cover various modifications and equivalent arrangements included within the spirit and scope of the present disclosure.

What is claimed is:

1. An organic light emitting diodes (OLED) display having differently composed OLEDs with respective different voltage-to-current characteristic curves, the display comprising:

a display unit including a plurality of data lines, a plurality of scan lines, a plurality of first subpixels having respective first OLEDs for emitting first colored lights in accordance with first image data representing a first color component of a multicolored image, a plurality of second subpixels having respective second OLEDs for emitting second colored lights in accordance with second image data representing a second color component of the multicolored image, and a plurality of third subpixels having respective third OLEDs for emitting third colored lights in accordance with third image data representing a third color component of the multicolored image, the first, second and third color, component being different from one another, wherein the plurality of first, second, and third subpixels are connected to corresponding ones of the data lines and of the scan lines;

a scan driver configured for supplying a plurality of scan signals to the plurality of scan lines;

a data driver configured for generating a plurality of data signals corresponding to the first to third image data and supplying a plurality of data line signals to respective ones of the plurality of data lines;

a power supply unit configured for applying a first driving voltage to the plurality of first and second subpixels and for separately applying a second driving voltage of independently controlled magnitude to the plurality of third subpixels; and a power source controller configured to extract for each to be displayed image frame, each maximum grayscale value of the first to third image data and configured to variably control the first and second driving voltages according to the extracted maximum grayscale values, wherein the third OLEDs are differently composed than either of the first and second OLEDs and the third OLEDs have a different voltage-to-current characteristic curve than those of the first and second OLEDs.

2. The organic light emitting diode (OLED) display of claim 1, wherein the first color is one of green and blue, the second color is the other of green and blue, and the third color is red.

3. The organic light emitting diode (OLED) display of claim 1, wherein the power source controller varies the magnitude of the first driving voltage as corresponding to the largest grayscale value among the extracted maximum grayscale values of the first and second image data and varies the magnitude of the second driving voltage as corresponding to the extracted maximum grayscale value of the third image data.

4. The organic light emitting diode (OLED) display of claim 1, wherein the plurality of first to third subpixels respectively each includes:

a driving transistor and an organic light emitting diode (OLED) connected serially between one of a first and a second driving voltage supplying terminal and a third driving voltage supplying terminal; and a switching transistor operatively coupled to transmit a corresponding data signal to a gate of the driving transistor in response to an activating and corresponding scan signal.

5. A method of driving an organic light emitting diodes (OLEDs) display including a plurality of data lines, a plurality of scan lines, a plurality of first subpixels having respective first OLEDs for emitting light according to first image data representing a first color component of a to be displayed multicolored image, a plurality of second subpixels having respective second OLEDs for emitting light according to second image data representing a second color component of the to be displayed multicolored image, and a plurality of third subpixels having respective third OLEDs for emitting light according to third image data representing a third color component of the to be displayed multicolored image, wherein the plurality of first, second, and third subpixels are connected to corresponding ones of the data lines and the scan lines, the method comprising:

respectively applying a variable first driving voltage to the plurality of first and second subpixels; and respectively applying an independently variable second driving voltage to the plurality of third subpixels, wherein the first color is one of green and blue, the second color is the other of green and blue, and the third color is red, and the applying of the first driving voltage includes:

extracting each maximum grayscale value of the first and second image data by one frame unit; and varying the first driving voltage according to the largest grayscale value among the extracted maximum grayscale values.

6. The method of claim 5, wherein the applying of the second driving voltage includes: extracting a maximum grayscale value of the third image data by one frame unit; and varying the second driving voltage according to the extracted maximum grayscale value of the third image data.

* * * * *